US009085090B2

(12) United States Patent
Toncelli

(10) Patent No.: US 9,085,090 B2
(45) Date of Patent: Jul. 21, 2015

(54) PRESS FOR VACUUM VIBRO-COMPRESSION OF SLABS OR BLOCKS OR ARTICLES OF AGGLOMERATED OR CERAMIC MATERIAL

(76) Inventor: Luca Toncelli, Bassano del Grappa (IT)

( * ) Notice: Subject to any disclaimer, the term of this patent is extended or adjusted under 35 U.S.C. 154(b) by 124 days.

(21) Appl. No.: 13/814,372

(22) PCT Filed: Aug. 3, 2011

(86) PCT No.: PCT/IB2011/053460

§ 371 (c)(1),
(2), (4) Date: Feb. 5, 2013

(87) PCT Pub. No.: WO2012/017401

PCT Pub. Date: Feb. 9, 2012

(65) Prior Publication Data

US 2013/0136819 A1 May 30, 2013

(30) Foreign Application Priority Data

Aug. 6, 2010 (IT) ..... TV2010A0118

(51) Int. Cl.

| | |
|---|---|
| ***B28B 1/087*** | (2006.01) |
| ***B06B 1/16*** | (2006.01) |
| ***B28B 1/08*** | (2006.01) |
| ***B28B 3/02*** | (2006.01) |
| ***B30B 11/02*** | (2006.01) |

(52) U.S. Cl.
CPC . *B28B 1/087* (2013.01); *B06B 1/16* (2013.01); *B28B 1/082* (2013.01); *B28B 3/022* (2013.01); *B30B 11/022* (2013.01)

(58) Field of Classification Search
CPC ..... B28B 1/087; B28B 3/022; B30B 11/022
USPC ..... 425/421, 432
See application file for complete search history.

(56) References Cited

U.S. PATENT DOCUMENTS

| | | | |
|---|---|---|---|
| 3,302,262 | A | 2/1967 | Chanlund |
| 4,226,820 | A | 10/1980 | Bjoerhaag |

(Continued)

FOREIGN PATENT DOCUMENTS

| | | | |
|---|---|---|---|
| CN | 101391435 | A | 3/2009 |
| DE | 4320860 | A1 | 1/1994 |
| DE | 19640281 | A1 | 4/1997 |

(Continued)

OTHER PUBLICATIONS

"International Search Report and Written Opinion dated Nov. 2, 2011 for PCT/IB2011/053460, from which the instant application is based," 8 pgs.

*Primary Examiner* — James Mackey
(74) *Attorney, Agent, or Firm* — Feedrickson & Byron, P.A.

(57) ABSTRACT

A press for vacuum vibro-compression of slabs or blocks or articles of agglomerated or ceramic material comprises a ram with a pressing surface configured for generating a vibratory movement, so as to comprise a first and a second set of vibrating devices, each device being provided with at least one rotating shall with an eccentric mass. The shafts of the vibrating devices of one set rotate in the opposite direction to the shafts of the vibrating devices of the other set. Each set comprises at least two vibrating devices which are arranged with their respective axes not coaxial and interconnected by kinematic connection for rotating in synchronism.

16 Claims, 8 Drawing Sheets

(56) References Cited

U.S. PATENT DOCUMENTS

| | | | | |
|---|---|---|---|---|
| 4,725,220 | A * | 2/1988 | Percinel et al. | 425/432 |
| 4,830,597 | A * | 5/1989 | Steier et al. | 425/456 |

FOREIGN PATENT DOCUMENTS

| | | | |
|---|---|---|---|
| GB | 1504799 | A | 3/1978 |
| NL | 1023606 | C2 | 12/2004 |

* cited by examiner

PRESS FOR VACUUM VIBRO-COMPRESSION OF SLABS OR BLOCKS OR ARTICLES OF AGGLOMERATED OR CERAMIC MATERIAL

RELATED APPLICATIONS

This application is a 35 U.S.C. 371 national stage filing from International Application No. PCT/IB2011/053460 filed Aug. 3, 2011 and claims priority to Italian Application No. TV2010A000118 filed Aug. 6, 2010, the teachings of which are incorporated herein by reference.

FIELD OF THE INVENTION

The present invention relates to a press for compaction by means of vacuum vibro-compression of slabs or blocks or articles of agglomerated or ceramic material.

BACKGROUND

In order to manufacture slabs or blocks of agglomerated or ceramic material it is known to use presses for performing compaction by means of vibro-compression of the mixes of said materials.

In the remainder of the description specific reference will be made to the vibro-compression of slabs without however this being understood as having a limiting meaning A particular configuration of these presses comprises a support surface on which a tray or a mould filled with mix is placed, a vertically movable structure consisting of an outer bell member and a pressing ram sliding vertically inside it between a raised rest position in which it is separated from the mix to be compacted and a working position in which the ram is lowered until it comes into contact with the top surface of the mix to undergo vibro-compression, which may be lined with a sheet.

The vacuum vibro-compression environment, referred to below as "sealed chamber", is defined perimetrally by the bell member resting on the support surface of the press, below by the support surface itself and above by the ram. Said sealed chamber is connected to air extraction and vacuum generating means able to form the vacuum inside the chamber itself. A series of vibrating devices for generating a vibratory compaction movement is positioned on the press ram.

After the tray or the mould containing the mix has been transferred onto the support surface of the press, the bell member is lowered to form the sealed chamber, de-aeration of the chamber itself is then activated and at the same time the ram is lowered until it comes into contact with the material to be compacted. At this point the vibrating devices are activated so as to impart a vibratory movement to the ram and, at the same time, the ram is pressed with force against the material. The vacuum generating means which suck the air inside the chamber perform de-aeration of the mix; vacuum vibro-compaction is then carried out in order to compact the layer of mix owing to the compressive force exerted by the ram and the vibration imparted to the ram by the motorized vibrators.

According to the prior art in order to impart to the ram a purely vertical (unidirectional) vibration, therefore without horizontal components which would only prejudice the outcome of the compaction operation and subject the press structures to anomalous mechanical stresses, two sets of vibrators with rotating shafts having an eccentric mass are used, with the vibrators of one set counter-rotating with respect to the vibrators of the other set. In particular, a single vibrating device is used in each set, said device being formed usually by one or more rotating-shaft vibrators arranged in a row with coaxial axes. Each row of vibrators thus contains one or more rotating shafts with eccentric masses depending on the exciting vibration force which is to be obtained and the dimensions of the surface of the mix to be compacted. The rotating shafts are normally operated by electric motors or hydraulic motors.

In order to ensure maximum uniformity and efficiency of the single row of vibrators, they are coaxially connected together; therefore the vibrators of a same row all rotate in the same direction of rotation, but the direction of rotation of the vibrators of one row is opposite to the direction of rotation of the other row and therefore the two rows of vibrators counter-rotate with respect to each other.

Each vibrator is provided with one or more eccentric masses and in each row of vibrators these masses are arranged angularly in the same position. Moreover, when the vibrators are operated, the eccentric masses, owing to the minimum energy principle, are automatically arranged in phase opposition, namely the eccentric masses of the vibrators in one row are arranged angularly offset by 180° with respect to the masses of the vibrators in the other row, so as to nullify the horizontal component of the resultant force. Therefore normally it is not necessary to use a mechanical device for synchronizing the counter-rotation of the two rows of vibrating shafts.

It is clear that this type of configuration may be used in an optimum manner for slabs or blocks or articles of any length, by increasing the length of each vibrating device, namely the number of vibrators for each one of the two rows. It is not so simple to solve the problem of an increase in the width.

In order to obtain correct compaction of the material, the vibrating surface during its vibro-compressive movement must preferably perform a purely translatory vertical movement and must move rigidly without undergoing flexing and deformation in the two transverse and longitudinal vertical planes.

If the planar arrangement of the ram can be easily maintained in a direction of extension of the ram parallel to the axial direction of the vibrating devices (for example in the direction of the length of the article) since, as mentioned above, the number of vibrators can be increased for each row thus maintaining a uniform distribution of the forces when there is a variation in length of the slab, the same does not happen in the transverse direction, for example with an increase in the width of the article.

In fact, in this second case, the vibrating devices can be moved way from each other, but the increase in the interaxial distance between the two rows of vibrators increases the interaxial distance of the forces applied on to the ram and therefore the ram is acted on by forces which are increasingly less uniform and tend to deform it in the transverse vertical direction. This adversely affects compaction and may also impair the planar arrangement which is no longer ensured.

Moreover, the vibrating force needed to cause vibration of a ram which has a greater width and therefore heavier weight results in the need to increase the magnitude of the rotating masses on each shaft, but this conflicts with the limitations applicable to the load acting on the bearings.

By way of example, FIG. 1 shows in schematic form a cross-sectional view of a ram 350 of a press according to the prior art provided with two rows of vibrators 310,320.

FIG. 2 shows instead in schematic form a cross-sectional view of a ram 450 of a press of the prior art modified, namely with the ram which has been widened so as to be able to compact articles of greater width. The ram 450 is provided, as in the previous example, with two rows of vibrators 410,420.

It is evident from the drawing that only two rows of vibrators can only form a limited source of vibrating force. Also, in view of the existing limits for construction of the bearings in relation to the speed of rotation required for compacting the slabs, it is not possible to increase the size of the eccentric masses generating the vibration. Moreover, the lack of uniformity of application of the vibrating forces along the length of the ram is evident.

Therefore, when it is required to compact articles with a width greater than the maximum width permitted by the current configuration of the vibrators, a different configuration of said vibrators must be defined in order to obtain the expected result.

In order to solve the problem of correct compaction, the person skilled in the art, however, does not consider it possible to increase the number of vibrating devices arranged alongside each other in order to increase the force and the uniformity of vibration. In fact, it has been found that in such a press an increase in the number of rows (or vibrating devices) in the sets produces, on the contrary, a reduction in the vibrating movement imparted, down to a value of practically zero. In fact, owing to the minimum energy principle, the eccentric masses of a greater number of rows tend to be arranged so that these vibrating movements generated by the rows are self-cancelling and the resultant vibratory movement is practically zero.

BRIEF SUMMARY OF EMBODIMENTS OF THE INVENTION

The object of the present invention is therefore to provide a press for the vibro-compaction by means of vacuum vibro-compression of blocks or articles of agglomerated or ceramic material, which may also be of considerable width, in which an improved and satisfactory vibrating effect, uniformly distributed in a satisfactory manner over the press ram, is obtained. This object is achieved by a press for vacuum vibro-compaction of slabs or blocks or articles of agglomerated or ceramic material comprising a ram with a pressing surface provided with means for generating a vibratory movement, comprising a first and a second set of vibrating devices, each device being provided with at least one rotating shaft with an eccentric mass, the shafts of the vibrating devices of a one set rotating in the opposite direction to the shafts of the vibrating devices of the set, characterized in that each set comprises at least two vibrating devices which are arranged with their respective axes not coaxial and interconnected by kinematic connection means for rotating in synchronism.

Advantageously, the devices in each set have parallel and adjacent shafts. The vibrating devices of each set may also comprise a plurality of eccentric masses arranged spaced along the shaft. A motor for rotation of the shaft may be associated with each eccentric mass or advantageously with pairs of eccentric masses, and the kinematic connection means may kinematically connect the shafts at several points along the length of the shafts.

In particular, it is possible to envisage advantageously dividing each shaft into coaxially interconnected segments, with each segment which forms a shaft of a rotational motor associated with a respective eccentric mass or pair of eccentric masses of the plurality, so as to form along the shaft a row of coaxial vibrating stages.

All this allows the formation of a highly modular system.

Moreover it is pointed out that, during operation, owing to the minimum energy principle mentioned above, the eccentric masses of the vibrators of the first set are arranged angularly offset with respect to those of the vibrators of the second set so that the vibrating effects are added together in the direction perpendicular to the pressing surface and substantially cancel out those in the direction parallel to said surface.

Consequently, with a vibrating system according to the invention the vertical components of the vibratory movement generated by the first set of vibrators are added to those generated by the second set of vibrators, while the horizontal components of the first set are opposite to those of the second set and therefore cancel out each other.

By having, therefore, for example four rows of vibrators, or even more, equally divided into two sets in which the resultant vibratory movement is the sum of the vibratory movement generated by all the vibrators, it is possible to provide rams of considerable width, ensuring the planar arrangement of the ram during vibro-compression. It is therefore possible to compact in an optimum manner articles having widths greater than those of the articles manufactured hitherto.

BRIEF DESCRIPTIONS OF DRAWINGS

These and other advantageous features of the present invention will become clear from the following detailed description provided solely by way of a non-limiting example with reference to the following accompanying drawings in which.

DETAILED DESCRIPTION OF EMBODIMENTS OF THE INVENTION

Figure 1:
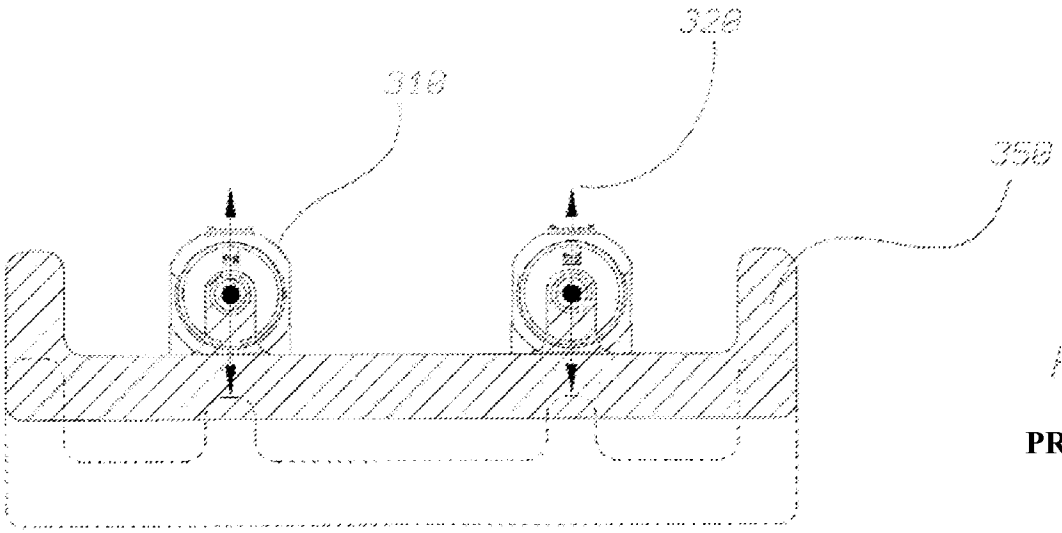
Fig. 1 PRIOR ART
FIG. 1 is a schematic cross-sectional view of a ram of a press according to the prior art.
Figure 2:
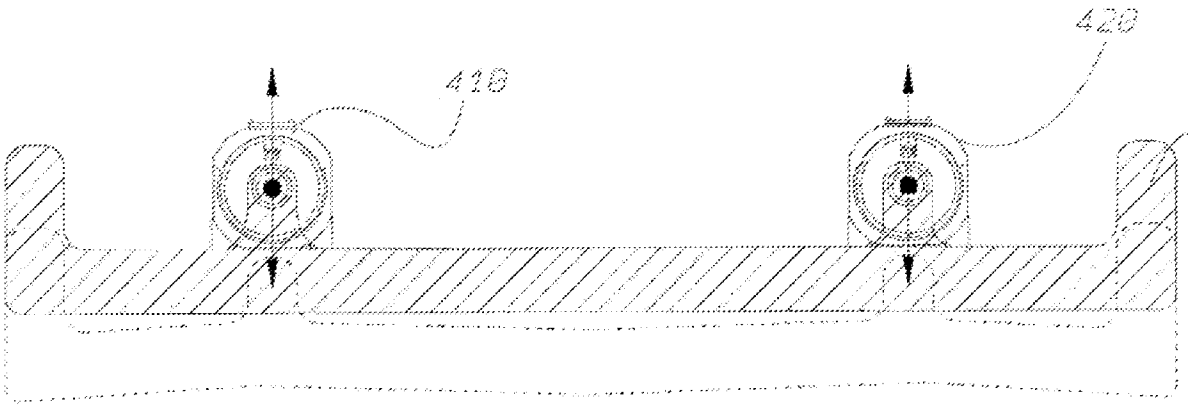
Fig. 2 PRIOR ART
FIG. 2 is a schematic cross-sectional view of a ram of a press according to the prior art, which has been widened.

In FIGS. 3, 4 and 5, 10 denotes overall a press for the vibro-compaction by means of vacuum vibro-compression of slabs of agglomerated or ceramic material.

The press 10 comprises a base 12 having, fixed thereon, a support surface 14 onto which a mould or tray 20 filled with a mix of agglomerated or ceramic material lined with a top sheet 24 is fixed.

Figure 6:
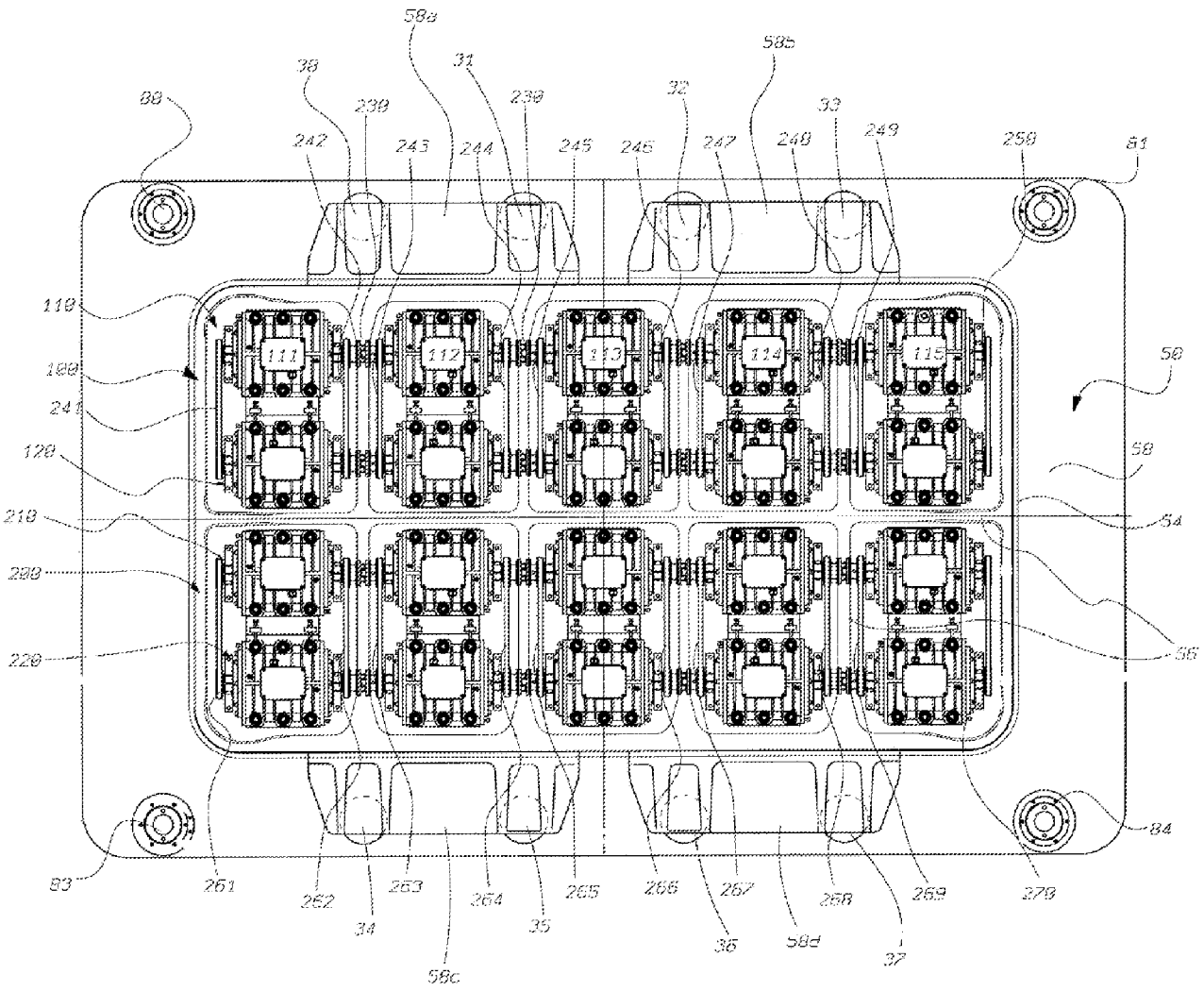
FIG. 6 is a top view of the ram of the press according to FIG. 3.

The press 10 also comprises hydraulic cylinders 30,31,32, 33,34,35,36,37 which are fixed to the surface 14—at least partially visible in FIG. 6—and inside each of which a respective rod slides, the top free end thereof being fastened to a ram 50. It is pointed out that the figures show only the rods 40,44 and the associated top free ends 40*a*,44*a* of the cylinders 40,44, respectively.

The ram 50 comprises a high-rigidity reticular structure consisting of a perimetral rib 54 and a series of internal ribs 56 connected at the bottom to a pressing surface 52.

Four brackets 58*a*,58*b*,58*c*,58*d* are connected laterally onto the perimetral rib 54 and have, fixed thereon, the free end of the rods of the cylinders 30,31, the cylinders 32,33, the cylinders 34,35 and the cylinders 36,37, respectively.

The press 10 comprises advantageously a vertically movable bell member 60 comprising a peripheral side wall 60A and a cover 60B inside which the pressing surface 52 slides. A series of dynamic seals for the vacuum, which can be easily imagined by the person skilled in the art and therefore not shown in the figures, are provided between the pressing surface 52 and the peripheral side wall 60A of the bell member 60.

Figure 4:
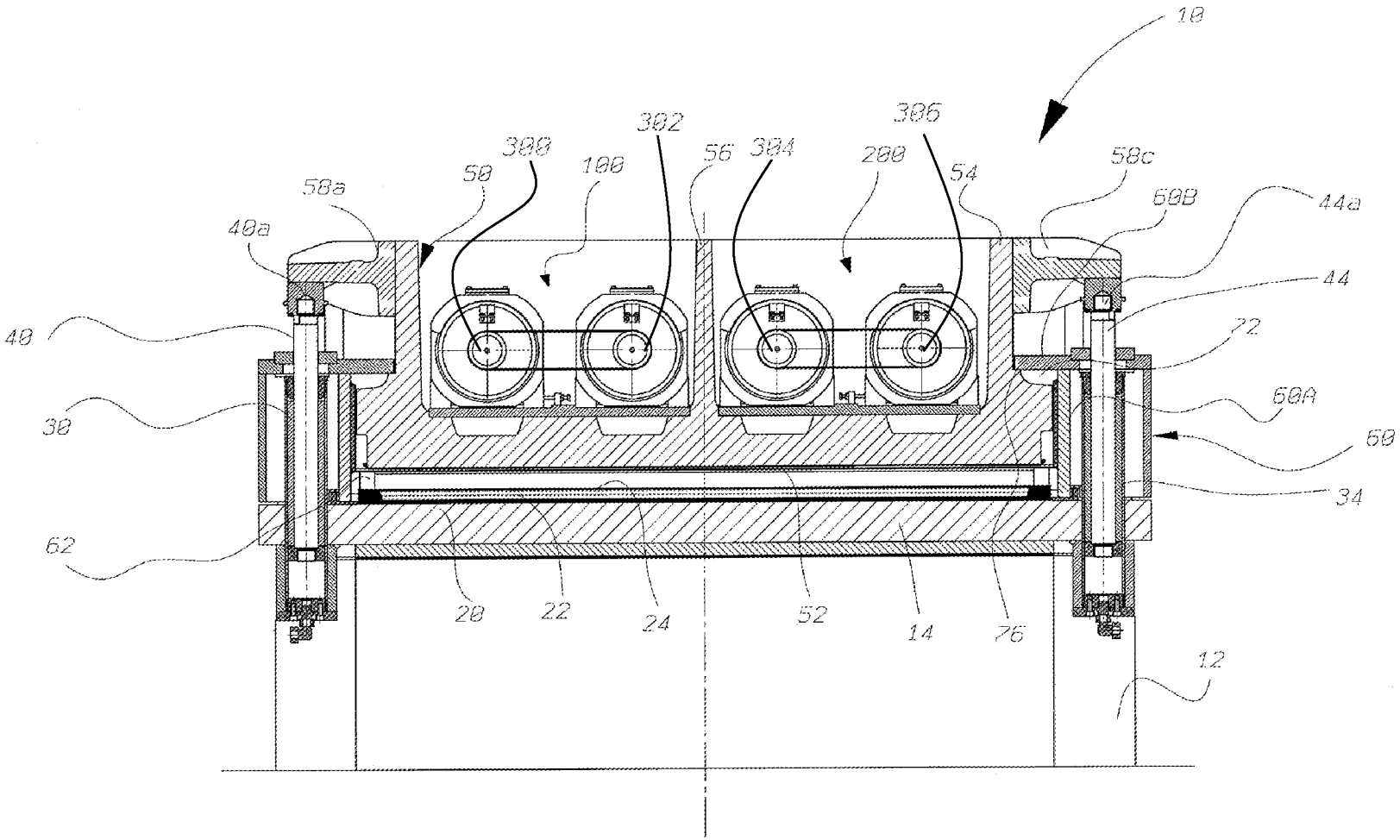
FIG. 4 is a view similar to that of FIG. 3 in which the press is shown in an intermediate working position where the ram is raised and the bell member is lowered.
Figure 5:
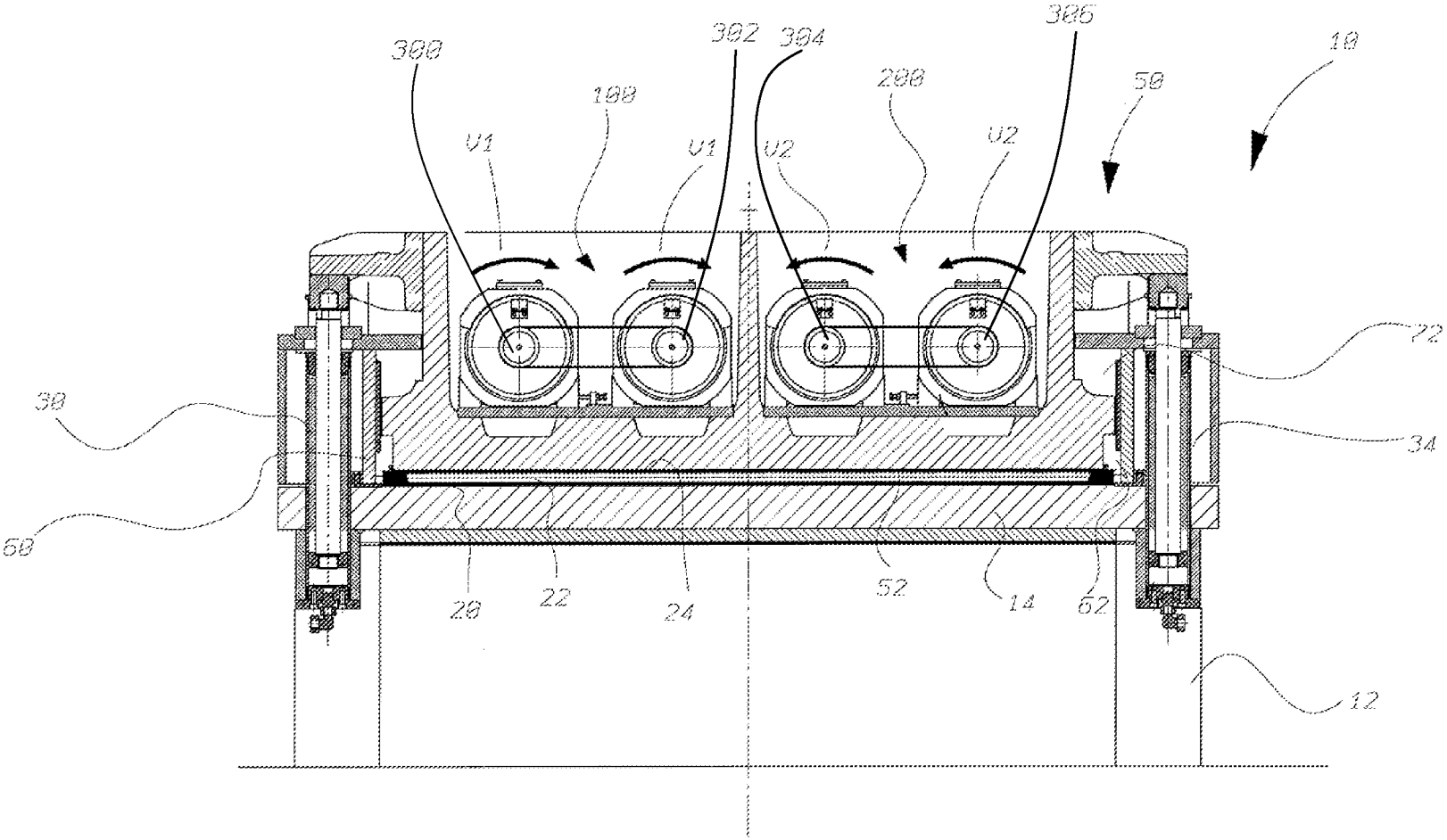
FIG. 5 is a view similar to that of FIG. 3 where the press is shown in the working position in which both the ram and the bell member are lowered.

As shown in FIGS. 4 and 5, when the bell member 60 rests on the support surface 14, a sealed chamber 62 is defined between the peripheral side wall of the bell member 60, the support surface 14 and the pressing surface 52. The bottom chamber 62 is connected to known vacuum generation means, such as a vacuum generating plant, which is known per se and therefore not shown in the figures, able to draw off the air contained therein and therefore de-aerate the mix 22 to be compacted.

The perimetral rib 54 of the ram 50 is also free to slide vertically in an air-tight manner inside the cover 60B.

An upper sealed chamber 72 is defined between the pressing surface 52, the peripheral side wall 60A and the cover 60B of the bell member 60. The upper chamber 72 is connected to a compressed-air plant, which is known per se and therefore not shown in the figures, so as to create an overpressure inside it, the function of which will be described below.

Figure 3:
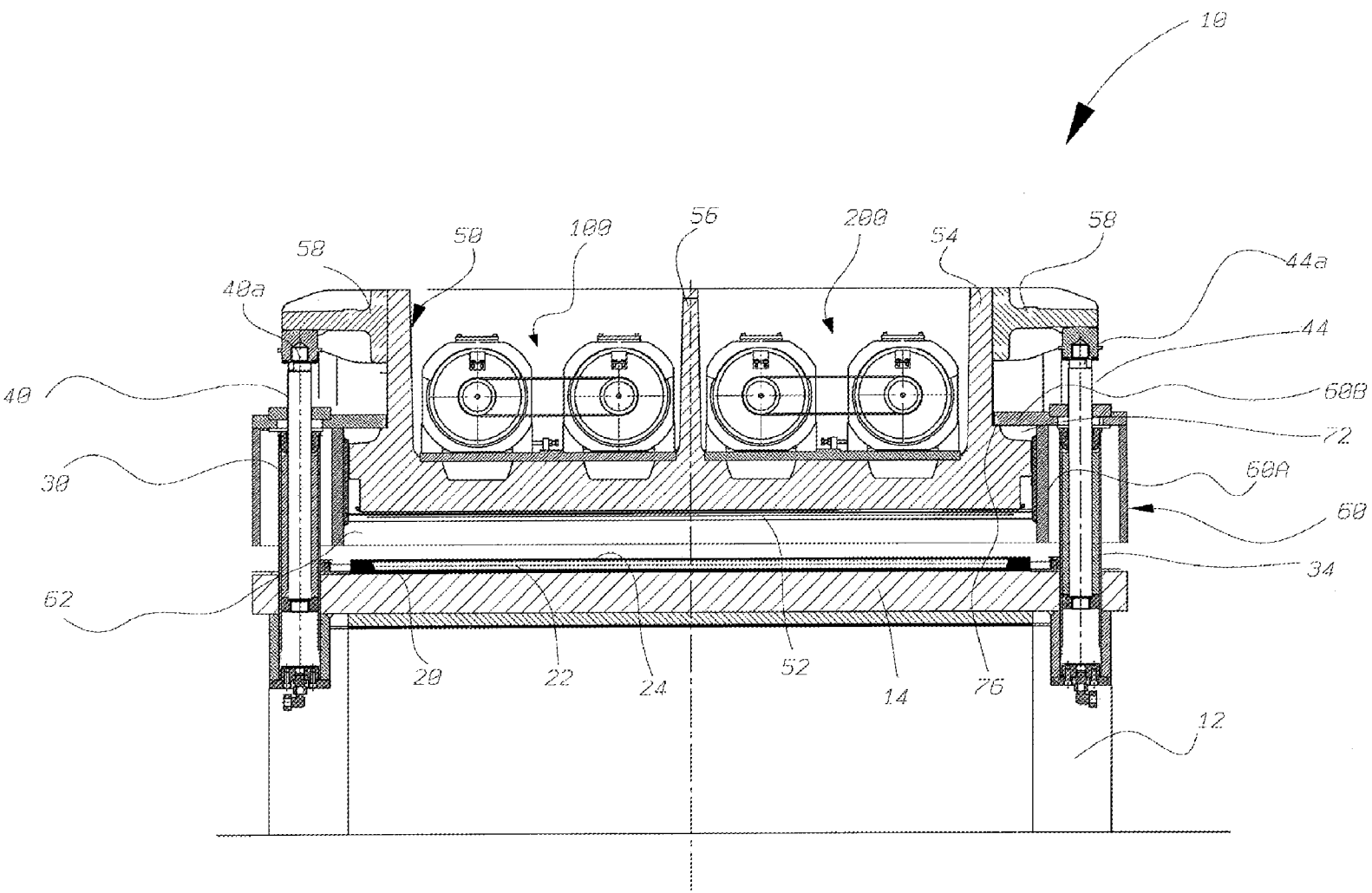
FIG. 3 is a cross-section through the press according to the present invention shown in the rest condition where both the ram and the bell member are shown in the raised position.

Moreover, the cover 60B of the bell member 60 is intended to rest on a perimetral shoulder 76 formed on the perimetral rib 54 when the ram 50 is raised, as shown in FIGS. 3 and 4.

Figure 8:
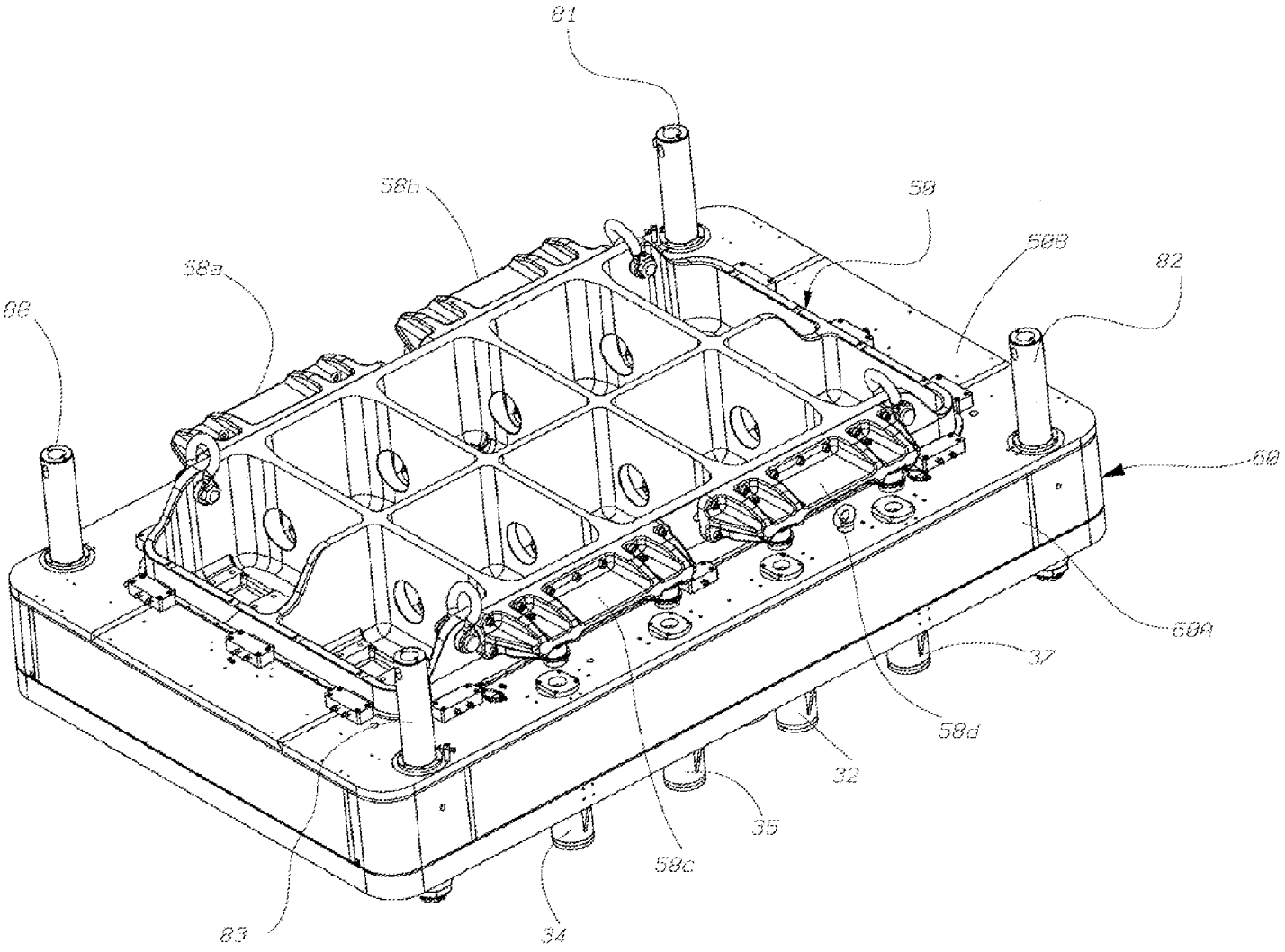
FIG. 8 is a perspective view of the ram and the bell member of the press according to FIG. 3.

As shown in FIG. 8, the cover 60B of the bell member 60 has, formed therein, four holes inside which four cylindrical columns 80,81,82,83 which are fixed at their bottom ends to the frame 12 are free to slide so as to guide the raising and lowering movement of the bell member 60.

When the rods of the cylinders 30,31,32,33,34,35,36,37 are in the fully raised position, the ram 50 is raised and therefore the pressing surface 52 is spaced from the support surface 14, as indicated in FIG. 3. Owing to the perimetral shoulder 76, the ram 50 also keeps the bell member 60 raised.

Instead, by retracting the rods inside the respective cylinders, the ram 50 and the bell member 60 move towards the support surface 14 until the bell member 60 comes into contact with the support surface, as indicated in FIG. 4. At this point, by lowering further the rods of the cylinders, the ram 50 is lowered until the pressing surface 52 comes into contact with the top sheet 24 so as to be able to compress the mix enclosed between the mould 20 and the top sheet (see FIG. 5).

As can be clearly seen from FIG. 6, a first set 100 and a second set 200 of vibrating devices are arranged above the pressing surface 52. The two sets are substantially symmetrical with respect to a central plane perpendicular to the pressing surface.

The vibrating devices of each set are at least two in number and each have a shaft 300, 302, 304, 306 rotating with suitable eccentric masses 308, 310, 312, which are advantageously arranged at intervals along the length of the shaft. The vibrating devices of one set rotate in the opposite direction to those of the other set. Moreover, the at least two vibrating devices of each set have their shafts kinematically interconnected so as to rotate in synchronism, as will become clear from the following description of a possible advantageous embodiment.

In the embodiment shown, the vibrating devices have parallel and adjacent shafts. The rotating masses 308, 310, 312 are advantageously distributed along the length of the shaft, as are, again advantageously, the means for connection between the kinematically interconnected shafts. Each eccentric mass has advantageously an associated—electric or hydraulic—motor 312, 318 for rotation of the shaft. Advantageously, each shaft is divided into coaxially interconnected segments, each provided with at least one eccentric mass 312, 314 and a motor 312, so as to form along the shaft a row of vibrating stages (or simply vibrators) which are substantially identical to each other. In accordance with an embodiment of the invention the eccentric masses 312, 314 are two in number and arranged at the ends of each coaxially interconnected shaft segment.

In the embodiment shown, the first set 100 comprises a first and second row of vibrators 110 and 120 and the second set 200 comprises in turn a first row and a second row of vibrators 210 and 220.

In the example, each row contains five vibrators: the first row 110 contains for example the vibrators 111,112,113,114, 115.

The vibrators of each row are coaxial and the respective shafts (which are advantageously the shafts of the motors) are rigidly connected together by means of couplings 230 so as to form the shaft 300, 302, 304, 306 of the vibrating device.

Figure 7:
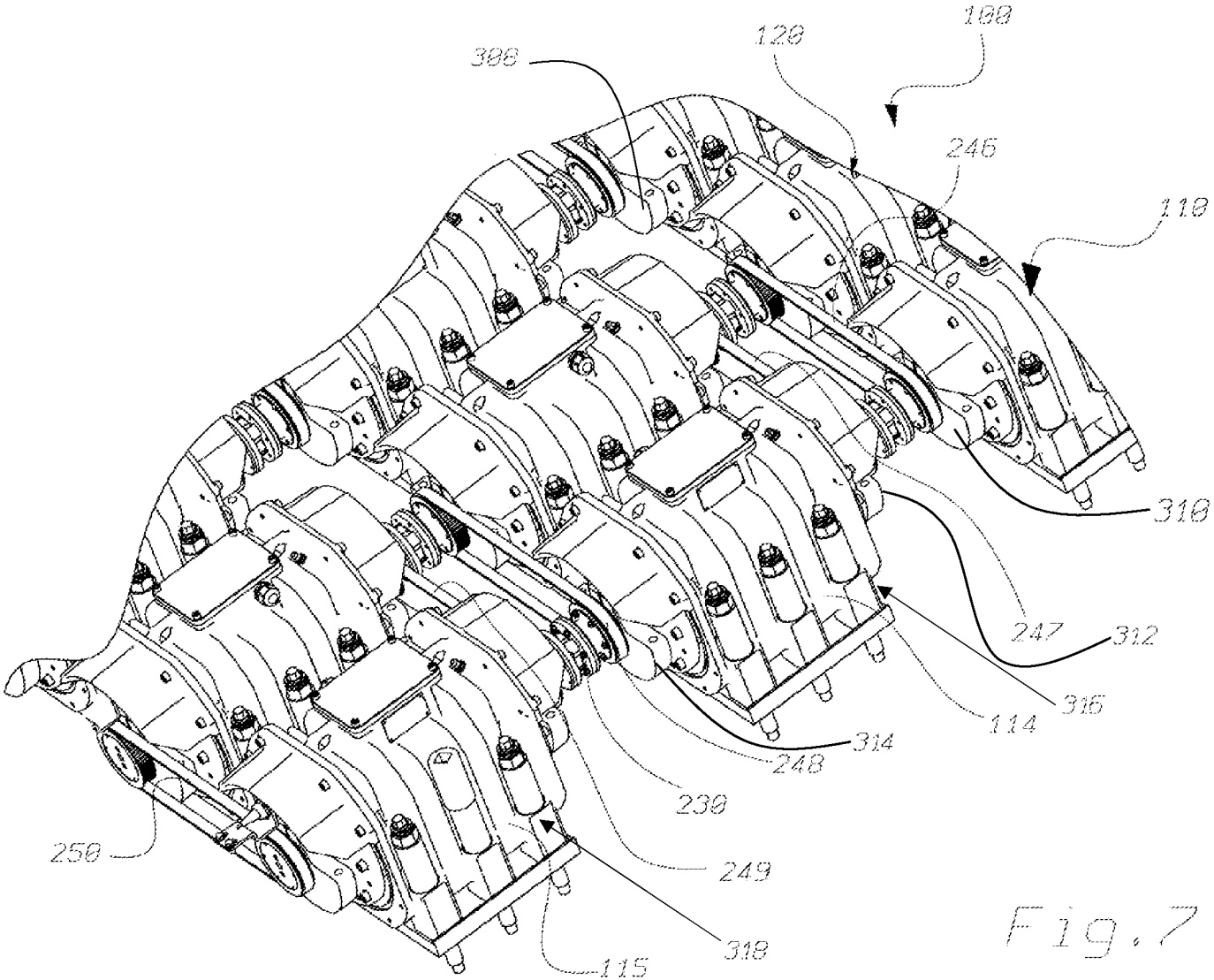
FIG. 7 is a partial perspective view of the vibrating means of the press according to FIG. 3.

It should be noted that the shafts of the vibrators of the first row 110 are mechanically connected to the shafts of the vibrators of the second row 210 by means of toothed belts, precisely ten toothed belts 241,242, . . . 250 which engage inside respective toothed pulleys, which can be seen more clearly in FIG. 7, where the vibrators of the first row 110 and second row 120 of the first set 100 are shown in greater detail.

Similarly for the second set 200, the shafts of the vibrators of the first row 210 are connected mechanically to the shaft of the vibrators of the second row by means of ten toothed belts (261,262, . . . 270) which engage inside respective toothed pulleys.

The said means for kinematically connecting together the shafts 300, 302, e 304, 306 of the vibrating devices of each set are thus formed, said means being advantageously distributed along the shaft so as to distribute the stresses, reduce possible torsional torques and advantageously render the stages modular. With the connection means arranged at the two ends of each stage (as can be clearly seen in FIG. 6) each stage forms an advantageous modular unit, which can be easily reproduced in varying numbers so as to be able to design the press ram in different sizes, by adding several units alongside each other.

As can be noted from FIG. 5, during operation of the press, the vibrators of the first set 100 rotate in a clockwise direction as indicated by the arrows V1, while the vibrators of the second set 200 rotate in the anti-clockwise direction indicated by the arrows V2 and therefore are counter-rotating with respect to the vibrators of the first set. The direction of rotation of the two sets could, however, be reversed.

As mentioned, each vibrator is provided with at least one eccentric mass M and, as schematically shown in FIGS. 9, 10, 11, 12 and 13, the eccentric masses of the vibrators of each set are arranged angularly in the same position.

The eccentric masses M1 of the vibrators of the first set 100, during operation, are arranged angularly offset by 180° with respect to the masses M2 of the vibrators of the second set 200, namely in an angularly opposite position, as shown below.

Figure 9:
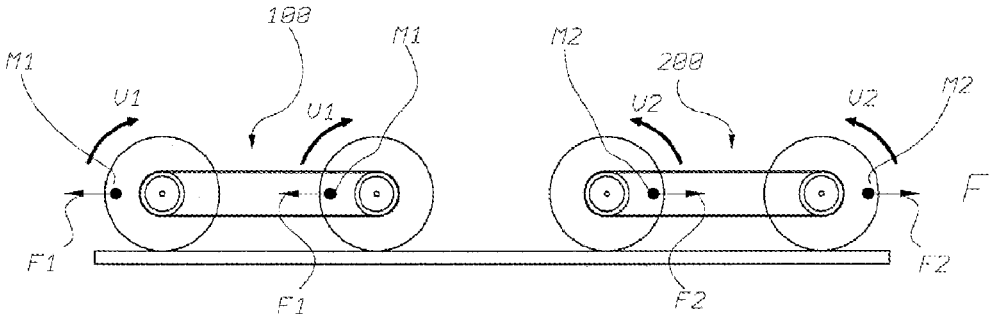
FIGS. 9, 10, 11, 12 and 13 are schematic cross-sectional views of the vibrators which show the position which the eccentric masses assume during regular operation thereof.

With reference to the position shown in FIG. 9 in which the eccentric masses M1 of the first set 100 are arranged to the left and therefore the eccentric masses M2 of the second set 200 are arranged to the right, it can be noted that the centrifugal forces F1 of the eccentric masses M1 of the first set 100 are directed towards the left, while the centrifugal forces F2 of the eccentric masses M2 of the second unit 200 are directed towards the right so that the overall centrifugal force generated by all the vibrators is zero.

Figure 10:
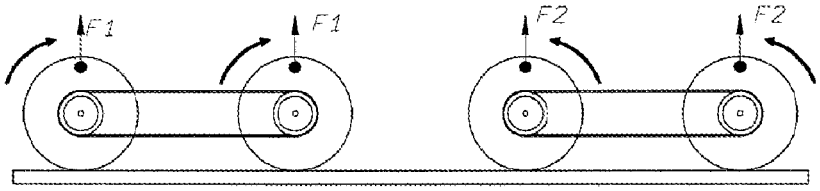

After a quarter of a revolution, considering that all the shafts of the vibrators of the first set 100 rotate in a clockwise direction (direction V1) and the shafts of the vibrators of the second set 200 rotate in an anti-clockwise direction (direction V2), the eccentric masses assume the position indicated in FIG. 10, namely they are all directed upwards so that the total centrifugal force is the sum of the centrifugal forces generated by all the vibrators and is directed upwards.

Figure 11:
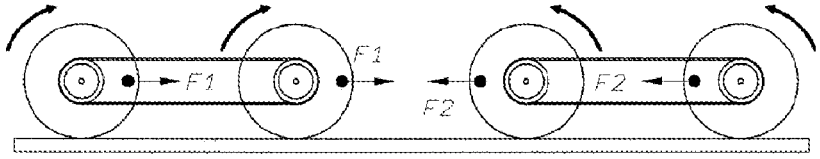

After another quarter of a revolution the configuration indicated in FIG. 11 is obtained where the eccentric masses M1 of the first set 100 are directed towards the right and the eccentric masses M2 of the second set 200 are directed towards the left so that the resultant centrifugal force is zero.

Figure 12:
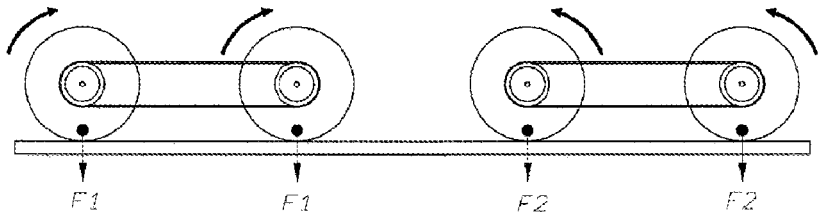

After another quarter of a revolution the eccentric masses are arranged as shown in FIG. 12 where all the masses are directed downwards and therefore the resultant centrifugal force is the sum of the centrifugal forces generated by all the vibrators and is directed upwards.

Finally after another quarter of a revolution the initial configuration shown in FIG. 9 is returned to.

Figure 13:
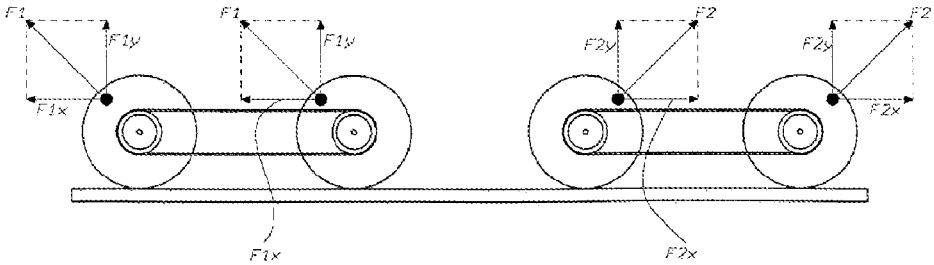

FIG. 13 shows instead a generic intermediate configuration of the masses where the centrifugal forces F1 and F2 have both a horizontal component $F1_X$, $F2_X$ and vertical component $F1_Y$, $F2_Y$ from where it can be noted that the horizontal components $F1_X$, $F1_X$ still cancel out each other, while the vertical components $F1_Y$, $F2_Y$ are added together.

It is evident therefore that the vibrating devices generate a pulsating force which is always directed vertically and which has an intensity varying regularly between a maximum value directed upwards and a maximum value directed downwards.

Owing to the kinematic connection formed by the toothed belts which connect the shafts of the vibrating devices of each set, the eccentric masses of each set always maintain the same relative position.

Moreover, it has been noted that the eccentric masses of the first set and the second set always have a phase displacement of 180° as defined above, since the latter is the smallest energy position, a position which any system tends to reach and maintain.

The operating principle of the press 10 is now described.

Starting from the position shown in FIG. 3 where the ram 50 is raised and the mould 20 containing the mix 22 rests on the support surface 14, the rods of the cylinders 30,31,32,33,34,35,36,37 are lowered so that the ram 50 is lowered and the bell member 60 comes into contact with the support surface 14, thus reaching the position shown in FIG. 4. At this point the vacuum plant connected to the bottom chamber 62 is activated so as to start de-aeration of the mix and favour the next step, i.e. the complete retraction of the rods so that the pressing surface 52 comes into contact with the top sheet 24 which lines the mix (see FIG. 5).

The compressed-air plant is activated so as to increase the pressure inside the upper chamber 72 so that the ram 50, or rather the pressing surface 52, suitably presses against the top sheet 24.

The sets of vibrators 110,120 are thus activated and, owing to the abovementioned sequence, impart a purely vertical vibrating movement to the ram 50.

The mix 22 is thus vibro-compressed in a vacuum environment, thus producing a uniformly compacted slab.

Subsequently the atmospheric pressure inside the bottom chamber 62 is restored. At this point it is possible to raise the rods of the cylinders 30,31,32,33,34,35,36,37 which raise the ram 50 and therefore also the bell member 60 by means of the perimetral shoulder 76.

Therefore, as a result of the press according to the present invention, it is possible to generate a pulsating force which imparts a vibratory movement to the ram 50 which is uniform and satisfactory, also in the case of the latter having a considerable width, nevertheless ensuring that the forces generated vertically by the individual vibrating devices are added together while preventing them from being able to cancel out each other, even only partially, while instead the horizontal components cancel out each other.

Finally it is evident that any variant or modification which is functionally equivalent falls within the scope of the present invention.

For example, instead of envisaging belt drives for interconnecting the movement of the shafts of each set, it is possible to envisage other mechanisms such as gear wheels or chains.

It is also possible to envisage means for mechanical connection, for example gears or the like, between the rows of vibrating devices of the first set and those of the second set which in any case allow the shafts of the vibrators of the two sets to counter-rotate with respect to each other.

It is also possible to envisage for each set three or more vibratory devices which are interconnected, instead of two, optionally formed by a number of rows of vibrators greater or smaller than that shown. The system for forming the vacuum chamber may also be different from that shown, as can be easily imagined by the person skilled in the art. The press may also comprise further known devices for the specific application. It is also possible to use a smaller number of motors for each shaft compared to the number of eccentric masses.

The invention claimed is:

1. Press for vacuum vibro-compression of slabs or bloCks or articles of agglomerated or ceramic material, comprising a ram with a pressing surface provided with means for generating a vibratory movement, the means comprising first and, second sets of vibrating devices, each of the vibrating devices being provided with at least one rotating shaft with an eccentric mass, the at least one rotating shaft of each vibrating device of one of the first and second sets rotating in an opposite direction to the at least one rotating shaft of each vibrating device of other of the first and second sets, wherein each of the first and second sets of vibrating devices comprises at least two vibrating devices having respective rotating shafts that are non-coaxial and are interconnected by kinematic connection means for rotating the at least two vibrating devices in synchronism, said kinematic connection means kinematically connecting the non-coaxial shafts at several points along length of the non-coaxial shafts, said vibrating devices of each of the first and second sets having parallel and adjacent shafts.

2. The press of claim 1, wherein each vibrating device of the first and second sets comprises a plurality of the eccentric masses spaced along the rotating shafts of the sets.

3. The press of claim 2, wherein each rotating shaft of the vibrating devices is divided into coaxially interconnected segments, wherein each segment forms a shaft of a rotating motor associated with at least one eccentric mass of the plurality, so as to form along each of the rotating shafts of the sets a row of coaxial vibrating stages.

4. The press of claim 2, wherein each rotating shaft of the vibrating devices is divided into coaxially interconnected segments, wherein each segment forms a shaft of a rotating motor associated with a pair of eccentric masses of the plurality, arranged at ends of each coaxially interconnected segment so as to form along each rotating shaft of the sets a row of coaxial vibrating stages.

5. The press of claim 3, further comprising the rotating motor for rotating each of the rotating shafts of the vibrating devices and being associated with each eccentric mass.

6. The press of claim 4, further comprising the rotating motor for rotating each of the rotating shafts of the vibrating devices and being associated with each pair of eccentric masses.

7. The press of claim 1, wherein said means for kinematically connecting the non-coaxial shafts comprise belt drives.

8. The press of claim 1, wherein said means for kinematically connecting the non-coaxial shafts comprise gear wheels extending from the non-coaxial shafts and meshing with each other.

9. The press of claim 1, wherein said means for kinematically connecting the non-coaxial shafts comprise chain drives.

10. The press of claim 1, wherein the at least one rotating shaft of each vibrating device of the first set and the second set are rigidly connected to each other by mechanical connection means which allow the rotating shafts of the vibrating devices of the first set to counter-rotate with respect to the second set.

11. The press of claim 2, wherein the plurality of eccentric masses of the vibrating devices of each of the first and second sets are angularly arranged in same positions around each of the respective at least one rotating shaft of each vibrating device.

12. The press of claim 1, wherein the eccentric masses of the vibrating devices of the first set and the second set are arranged in offset positions with respect to each other around the respective rotating shafts of the sets so that resultant in direction parallel to the pressing surface of force components generated by rotation of the rotating shafts of the sets is substantially zero.

13. The press of claim 1, wherein the ram has rectangular form and the at least one rotating shaft of each of the vibrating devices extend parallel to one side of the ram and the vibrating devices are arranged adjacent to each other in a direction transverse with respect to said one side.

14. The press of claim 1, further comprising a support surface for a slab or block or article to be compacted, a vertically movable structure consisting of an outer bell member inside which the ram is vertically slidable between a raised rest position, in which the pressing surface of the ram is separated from the slab or block or article to be compacted, and a working position in which the ram is lowered and in contact with an upper surface of the slab or block or article to be compacted; said bell member, said support surface and said pressing surface defining a sealed chamber when said bell member rests on said support surface and vacuum generating means being connected to said sealed chamber so as to produce a vacuum inside said sealed chamber.

15. The press of claim 14, wherein an upper chamber is defined above said ram, said upper chamber being defined by said ram and by said bell member and being connected to a compressed air source so as to push said ram downwards.

16. Press for vacuum vibro-compression of slabs or blocks or articles of agglomerated or ceramic material, comprising a ram with a pressing surface provided with means for generating a vibratory movement, the means comprising first and second sets of vibrating devices, each of the vibrating devices being provided with at least one rotating shaft with an eccentric mass, the at least rotating shaft of each vibrating device of one of the first and second sets rotating in an opposite direction to the at least one rotating shaft of each vibrating device of other of the first and second sets, wherein each set of vibrating devices comprises at least two vibrating devices having respective rotating shafts that are non-coaxial and are interconnected by kinematic connection means for rotating the at least two vibrating devices in synchronism, said vibrating devices of each of the first and second sets having parallel and adjacent shafts, wherein each vibrating device of the first and second sets comprises a plurality of the eccentric masses spaced along the rotating shafts of the sets, wherein each rotating shaft of the vibrating devices is divided into coaxially interconnected segments, wherein each segment forms a shaft of a rotating motor associated with at least one eccentric mass of the plurality, so as to form along each of the rotating shafts of the sets a row of coaxial vibrating stages, and wherein the kinematic connection means kinematically connect the non-coaxial shafts between the vibrating stages.

* * * * *

UNITED STATES PATENT AND TRADEMARK OFFICE

CERTIFICATE OF CORRECTION

PATENT NO. : 9,085,090 B2
APPLICATION NO. : 13/814372
DATED : July 21, 2015
INVENTOR(S) : Luca Toncelli It is certified that error appears in the above-identified patent and that said Letters Patent is hereby corrected as shown below:

In the claims,

Column 8, Claim 1, line 1: ...bloCks should read --blocks--

Column 8, Claim 1, line 4: ...and, should read --and--

Signed and Sealed this
Tenth Day of May, 2016

Michelle K. Lee

Michelle K. Lee
*Director of the United States Patent and Trademark Office*